United States Patent [19]

Sakata

[11] 4,019,085

[45] Apr. 19, 1977

[54] INTERNAL MAGNETIC SHIELD FOR CATHODE RAY TUBE

[75] Inventor: Shigeki Sakata, Nagaokakyo, Japan

[73] Assignee: Mitsubishi Denki Kabushiki Kaisha, Tokyo, Japan

[22] Filed: Sept. 10, 1975

[21] Appl. No.: 611,872

Related U.S. Application Data

[63] Continuation-in-part of Ser. No. 465,670, April 30, 1974, abandoned.

[30] Foreign Application Priority Data

May 2, 1973 Japan ..... 48-52556

[52] U.S. Cl. ..... 313/402; 313/479

[51] Int. Cl.[2] ..... H01J 29/06; H01J 29/07

[58] Field of Search ..... 313/402, 403, 404, 405, 313/406, 407, 408, 479; 315/8

[56] References Cited

UNITED STATES PATENTS

| | | | |
|---|---|---|---|
| 2,630,543 | 3/1953 | Cage | 313/402 |
| 3,546,517 | 12/1970 | Veith | 313/414 |
| 3,549,932 | 12/1970 | Lindeman | 313/407 |
| 3,737,703 | 6/1973 | Tsuneta et al. | 313/407 |
| 3,789,254 | 1/1974 | Yamazaki et al. | 313/407 |
| 3,846,658 | 11/1974 | Kasai | 313/408 |

OTHER PUBLICATIONS

Sarbacher, "Encyclopedia Dictionary of Electronics and Nuclear Engineering," Prentice–Hall, Inc.; Englewood Cliffs, N. J.; 1959.

*Primary Examiner*—Robert Segal

*Attorney, Agent, or Firm*—Wenderoth, Lind & Ponack

[57] ABSTRACT

An internal magnetic shield has a funnel of generally rectangular cross section and apertures disposed in all the walls of the funnel. Such shield is used in a color cathode ray tube to allow heat dissipation from a shadow mask to a funnel portion of an enclosed envelope of the tube.

5 Claims, 16 Drawing Figures

INTERNAL MAGNETIC SHIELD FOR CATHODE RAY TUBE

This is a continuation-in-part of application Ser. No. 465,670, filed Apr. 30, 1974, now abandoned.

BACKGROUND OF THE INVENTION

This invention relates to color cathode ray tubes for use, for example, in color television receivers and more particularly to improvements in a magnet shield disposed within such a cathode ray tube.

It is well known that cathode ray tubes for use in color television receivers are provided with a magnetic shield for eliminating the effects upon the cathode ray tubes due to terrestrial magnetism and/or undesirable magnetic fields caused by the electric circuit of the associated television receiver. It is also well known that such a magnetic shield is disposed within the enclosed envelope of a cathode ray tube to make the resulting shielding effect greater. The magnetic shield disposed within the envelope is called an "internal magnetic shield" and is generally connected by welding to a shadow mask disposed in the envelope.

However, such a magnetic shield joined to the shadow mask results in an increase in the undesirable thermal deformation of the shadow mask. This is due to the fact that the magnetic shield impedes the heat dissipation from the shadow mask to the envelope, and more particularly to the funnel portion thereof. On the other hand, the shadow mask is coupled to the interior of the envelope through supporting means, and therefore the magnetic shield connected to the shadow mask increases loading on such supporting means, leading to the necessity of rendering the supporting means stronger. It is desirable to make the magnetic shield as light as possible in weight.

SUMMARY OF THE INVENTION

Accordingly it is an object of the present invention to provide a shadow mask type color cathode ray tube including an improved magnetic shield which is capable of reducing undesirable thermal deformation of the shadow mask and which is also light in weight.

The present invention accomplishes this object by the provision of a color cathode ray tube for use in a color television receiver and including an enclosed envelope including a face plate, a funnel portion and a neck portion, a phosphor screen disposed on the internal surface of the face plate, electron gun means disposed within the neck portion to generate a beam of electrons, shadow mask means disposed in opposite relationship with the phosphor screen on the face plate to determine the landing of the electron beam from the electron gun means on the phosphor screen, and magnetic shield means within the envelope and including a funnel portion extending along the internal surface of the funnel portion of the envelope and coupled to and supported by the shadow mask means, the funnel portion of the magnetic shield means having apertures extending therethrough.

Preferably the apertures may be disposed in a predetermined pattern in the entire area of the funnel portion of the magnetic shield with a substantially uniform density.

BRIEF DESCRIPTION OF THE DRAWINGS

The present invention will become more readily apparent from the following detailed description taken in conjunction with the accompanying drawings in which.

DETAILED DESCRIPTION OF THE PREFERRED EMBODIMENTS

Figure 1:
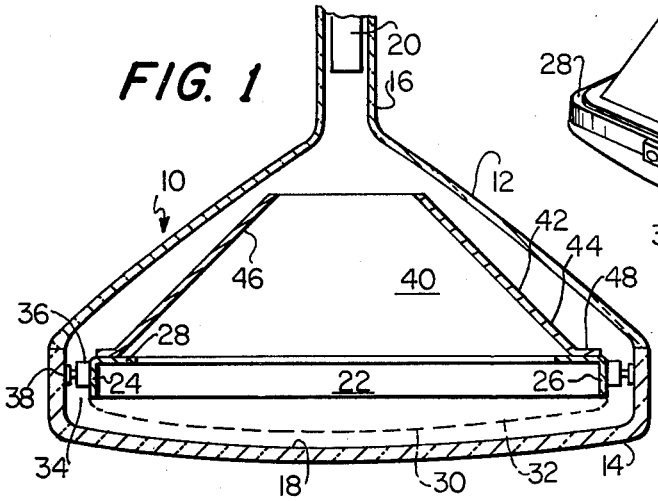
FIG. 1 is a longitudinal sectional view of a color cathode ray tube to which the present invention is applicable.

Referring now to FIG. 1 of the drawings, there is illustrated a general construction of a shadow mask type color cathode ray tube with an internal magnetic shield. This arrangement illustrated comprises an enclosed envelope 10 including a funnel portion 12, a face plate or a viewing panel 14 hermetically closing the larger end of the funnel portion 12, and a neck portion 16 contiguous to the smaller end of the funnel portion 12. The face plate 14 is provided on the internal surface thereof with a conventional mosaic screen 18 including blue, green and red phosphors, while the neck portion 16 has disposed therein a triad of conventional electron guns schematically designated by block 20.

The blue, green and red phosphors on the mosaic screen 18 are printed in the form of minute circles. Further, the face plate 14 has a metallic backlayer (not shown) disposed on the internal surface thereof to cover the screen 18, and the funnel portion 16 includes an electrically conductive layer (not shown) disposed on the internal surface thereof. Both the metallic backlayer and electrically conductive layer are electrically coupled to each other and serve to supply to the cathode ray tube an anode voltage produced by an associated television receiver, while being maintained at the same potential.

Within the envelope 10 adjacent the face plate 14 a shadow mask of the conventional construction, generally designated by the reference numeral 22, is disposed in opposite relationship with the phosphor screen 18. The shadow mask 22 includes a mask frame 24 of substantially L-shaped section having a short rectangular tube portion 26 encircling the longitudinal axis of the envelope 10 and a flange portion 28 extending from one end of the tube portion 26 remote from the face plate 18 inwardly toward the longitudinal axis of the envelope 10. Then an aperture mask 30 closes the rectangular tube portion 26 at the other end thereof by having its peripheral edge supported and welded to the frame 24. The aperture mask 30 has a multitude of small apertures 32 disposed in a predetermined pattern thereon. A plurality of, for example three or four, supporting means 34 are disposed around the shadow mask 22 and between the latter and the face plate 14 to support the shadow mask 22. Each of the supporting means 34 includes a spring member 36 welded at one end to the outer peripheral surface of the tube portion 26 and a supporting pin 38 planted on or attached to the internal surface of the face plate 14. Each spring member 36 has a free end fitted onto the respective pin 38 to resiliently support the shadow mask 22.

A beam of electrons from each electron gun 20 travels within the envelope 10 to pass through any of the apertures 32 on the shadow mask 22 after which the beam of electrons lands on the phosphor screen 18 at a portion thereof determined by that aperture 32 through which the beam passes. If any aperture 32 is displaced from its original position due to the thermal expansion of the aperture mask 30, or other reasons, then mislanding or landing of the beam on an unintended portion of the screen occurs, which considerably changes the color of light emitted from the phosphor screen 18. The thermal expansion of the aperture mask 30 is called "doming".

In color cathode ray tubes such as above described, it is common practice to dispose a magnetic shield within the envelope in order to prevent terrestrial magnetism and/or an undesirable magnetic field caused by television receivers from affecting the travel of the beam of electrons within the envelope 10. In FIG. 1 the magnetic shield is generally designated by the reference numeral 40 and is shown as including a funnel portion 42 encircling the longitudinal axis of the envelope 10 and extending along the internal surface of the funnel portion 12 of the envelope 10. The magnetic shield 40 is formed of a sheet of any suitable magnetic metal and has its outer peripheral surface 44 disposed in opposite relationship with the inner peripheral surface of the funnel portion 12, with an annular gap formed therebetween, and its inner peripheral surface 46 encircling a path of travel of an electron beam. The funnel portion 42 of the magnetic shield 40 has disposed at the larger end thereof an outwardly directed flange 48 welded to the flange 28 of the mask frame 24. Flange 48 serves to support the magnetic shield 40 on the shadow mask 22.

The shadow mask 22 is applied with a voltage through the supporting means 34, which voltage is the same as the anode voltage applied to the metallic backlayer on the internal surface of the face plate 14 of the enclosed envelope 10. Also the magnetic shield 40 is applied with the same anode voltage as above described.

Figure 2:
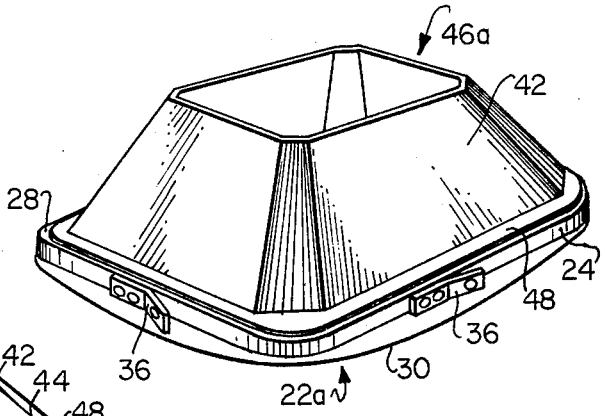
FIG. 2 is a perspective view illustrating a conventional internal magnetic shield for a color cathode ray tube along with an associated shadow mask.

In FIG. 2, wherein like reference numerals designate components identical to those shown in FIG. 1, there is illustrated a conventional internal magnetic shield such as shown in FIG. 1 having connected thereto a shadow mask. The magnetic shield and shadow mask are designated by the reference numerals **46*a* and 22*a*, respectively. As is apparent in FIG. 2**, conventional internal magnetic shields have been made merely of a sheet of any suitable magnetic metal shaped in the form of a funnel.

It has been heretofore known that in color cathode ray tubes, beams of electrons from the electron guns are selectively passed through the apertures on the shadow mask, thus transferring energy to the latter. Thus, the shadow mask increases in temperature, thus resulting in its thermal expansion. This thermal expansion of the shadow mask causes a change in an orbit of each electron beam, with the result that undesired or unintended color phosphor may emit light. This leads to a reproduced image being shifted and/or uneven in color.

Figure 3:
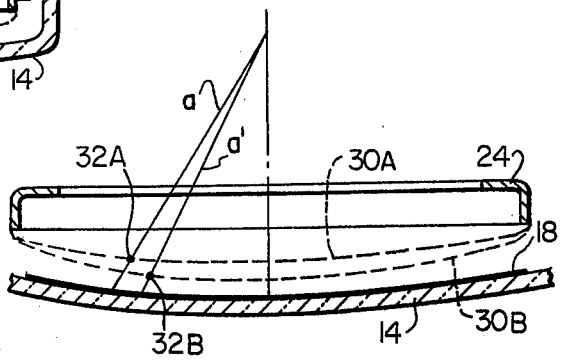
FIG. 3 is a fragmental sectional view illustrating a variation in an orbit of an electron beam due to the thermal expansion of the shadow mask in a color cathode ray tube.

FIG. 3 illustrates this change in the orbit of an electron beam due to the thermal expansion of the shadow mask. In FIG. 3, the shadow mask has been thermally expanded to change from its normal position 30A to an expanded position 30B. As a result, an orbit *a* of the electron beam passed through a given aperture at its normal position 32A on the shadow mask before the thermal expansion, is changed to travel along a line *a'* to pass through the same given aperture at its changed position 32B on the deformed shadow mask 30B. Therefore it will be seen that, after the shadow mask has been thermally expanded, the beam of electrons incorrectly lands on the phosphor screen 18 on the front face 14. The reference numeral 24 designates a frame for the shadow mask.

In color cathode ray tubes including the conventional internal magnetic shield as shown in FIG. 2, the thermal expansion of the shadow mask has led to color shifting and color uneveness being extremely large. As a result of experiments conducted with 20 inches, 110° deflection color cathode ray tubes, it has been found that, when using the conventional internal magnetic shield, resultant thermal expansion causes a deviation of a landing position for a beam of electrons to be increased by about 50% on that portion of a phosphor screen having the greatest deviation, as compared with no use of such a shield. This deviation of the landing position amounting to about 50% results in emission from quite undesirable phosphors. It is believed that the reason for which the deviation of the landing position is increased is that conventional internal magnetic shields interrupt the heat dissipation from the shadow mask so that the shadow mask reaches a high temperature compared to the shadow masks of color television cathode ray tubes not including an internal magnetic shield. This results in a increase in the thermal expansion of the shadow mask 22.

Figure 4:
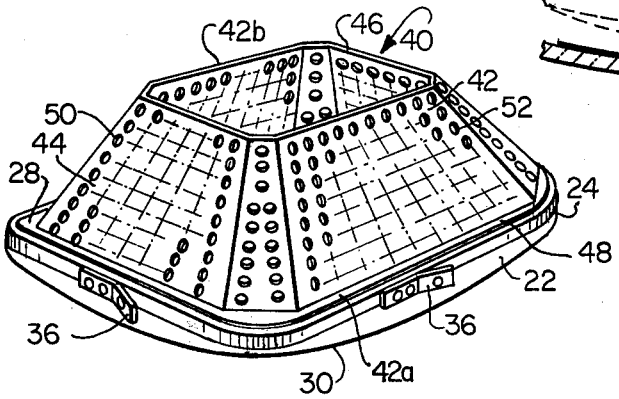
FIG. 4 is a perspective view illustrating an internal magnetic shield for use in a color cathode ray tube and constructed in accordance with the principles of the present invention, along with an associated shadow mask.

Referring now to FIG. 4, wherein like reference numerals designate components corresponding or similar to those shown in FIG. 1, there is illustrated an internal magnetic shield constructed in accordance with the principles of the present invention. The arrangement illustrated comprises an internal magnetic shield generally designated by the reference numeral 40 and a shadow mask generally designated by the reference numeral 22 and similar to that shown in FIG. 1 or 2. The magnetic shield 40 is formed of a cold rolled sheet steel having a thickness of 0.15 mm, for example, and includes a funel portion 42 having a multitude of apertures 50 extending therethrough. The apertures 50 are shown in FIG. 4 as being in the form of circles, whose diameter may be 6 mm, disposed in a predetermined pattern of all the walls of the funnel portion 42 with a substantially uniform density.

In 20 inches, 110° deflection color cathode ray tubes including the magnetic shield 40 as shown in FIG. 4, deviations of landing positions for beams of electrons on the phosphor screen were measured. The results of the measurement indicated that the deviation remained substantially unchanged as compared with color cathode ray tubes of the same type not including the magnetic shield 40. The reasons for improvement are believed to be that the apertures 50 serve to aid in transferring heat from the shadow mask 22 to the funnel portion 12 of the envelope 10 (see FIG. 1).

The funnel portion 42 of the magnetic shield 40 includes a large diameter end **42*a* jointly to the shadow mask means 22 and a smaller diameter end 42*b* spaced from the shadow mask means 22, and is included with a funnel region defining a runway along which a beam of electrons from the electron gun 20 travels toward the screen 18. This funnel region is a limited region in a space within the envelope 10 and has an inner peripheral surface coinciding with the inner peripheral surface 46 of the funnel portion 42, except for those portions thereof having the apertures 50 disposed therein, and an outer peripheral surface coinciding with the outer peripheral surface 44 of the funnel portion 42, except for those portions thereof having the apertures 50 disposed therein. Further, the funnel region extends from a first portion thereof at which the larger diameter end 42*a* is located, to a second portion thereof at which the smaller end 42*b* is located, so as to run along the inner peripheral surface of the funnel portion 42 of the envelope 10**.

The funnel region includes the funnel portion of the magnetic shield 40 of the main body thereof and the apertures 50 extending from the interior to the exterior of the funnel region.

The proportion of the area of the apertures 50 to the area of the funnel region as above defined is important. If the relative proportion of the area of the apertures 50 is too low, then the heat dissipation therethrough from the shadow mask 22 is decreased. On the contrary, if the relative proportion of the area of the apertures 50 is too high, then the magnetic shielding effect of the magnetic shield 40 is decreased. The proportion of the area of the apertures 50 is defined by the ratio of the total area of the apertures 50 to the entire area of the inner or outer peripheral surface of the funnel region as above described and is designated by $\alpha$. It has been found that the value of $\alpha$ may suitably be from 20 to 70%, and that a value of $\alpha$ ranging from 30 to 60% is most effective. If the relative proportion of the apertures 50 has a value within a range as above specified, then the heat dissipation from the shadow mask 22 will be improved while the magnetic shielding effect is not substantially reduced.

The apertures 50 also give the result that the sheet steel forming the funnel portion 42 is decreased in weight. This decrease in weight means that the supporting means 34 (see FIG. 1) for the shadow mask 22 can be less robust or strong and still support the magnetic shield 40.

By using a plurality of internal magnetic shields, such as shown in FIG. 4, each having apertures 50 disposed therein so that they are substantially uniformly distributed in the different portions of the funnel region as above described, but with each shield having different aperture proportions, the thermal deformation of associated shadow masks, the weights of the magnetic shields, and residual displacement due to effects of terrestrial magnetism have been measured. The results of the measurements are indicated in FIG. 4A, wherein the axis of the abscissa represents in percent relative aperture proportions $\alpha$, and the axes of the ordinate represent thermal deformation in mm of associated shadow masks, weights in grams of the magnetic shields, and residual displacement due to effects of terrestrial magnetism in mm.

Figure 4A:
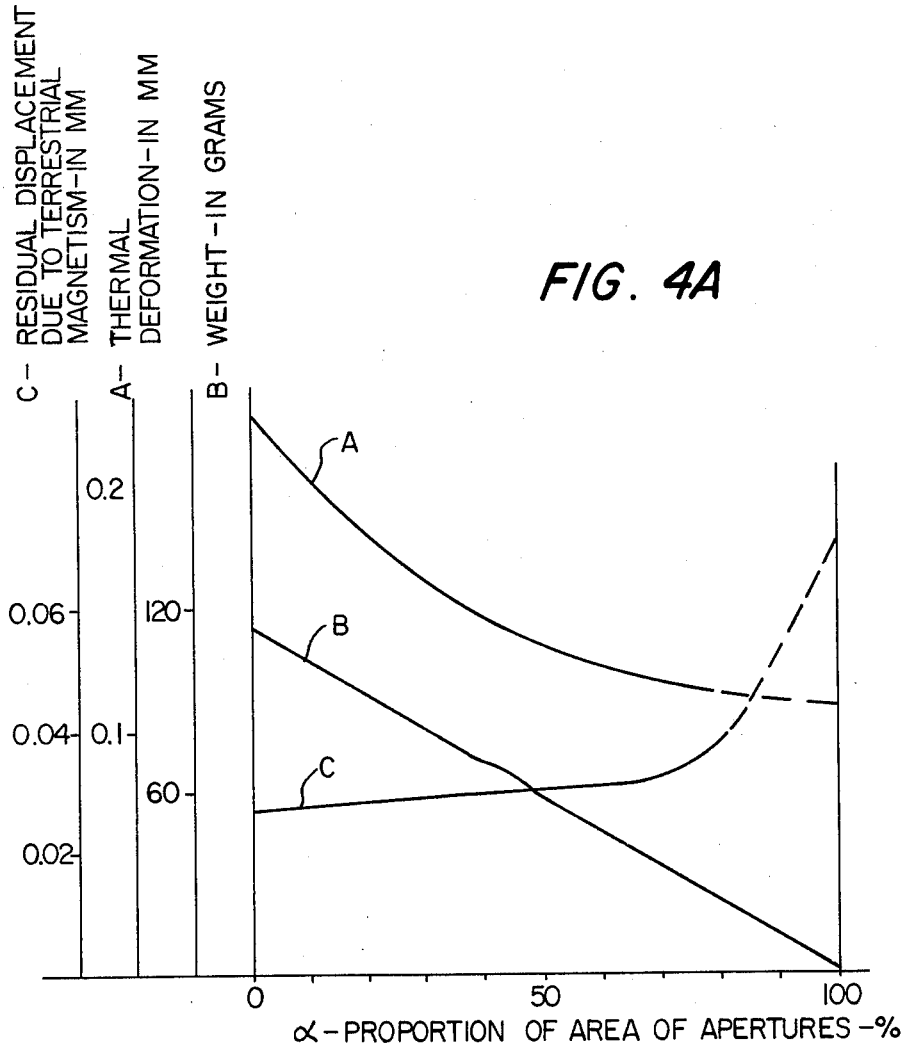
FIG. 4A is a graph illustrating the relationships between density of apertures of the internal magnetic shield and the amount of thermal deformation of the shadow mask, the weight of the magnetic shield, and the residual displacement due to effects of terrestrial magnetism on the beams of electrons.

In FIG. 4A curve A illustrates $\alpha$ versus thermal deformation of associated shadow masks 22 determined by measuring the distance along each tube axis between the mask position 30A before thermal expansion and the aperture masks position 30B after thermal expansion (see FIG. 3). The values were measured when three minutes had elapsed after commencement of operation of the associated television receivers.

Curve B illustrates $\alpha$ versus the weight of the associated magnetic shields.

Curve C illustrates $\alpha$ versus residual effects of terrestrial magnetism obtained as follows. While terrestrial magnetism includes both vertical and horizontal components, the vertical component thereof may be considered to substantially equally affect television receivers disposed within one country, for example within Japan. This is due to the fact that all television receivers are usually installed with the tube axes of the cathode ray tubes parallel to the surface of the earth. Therefore, the vertical component of terrestrial magnetism is scarcely affected by locations of particular television receivers within a given geographical area. Further, it is common practice to substantially eliminate the effect of the vertical component, such as by the use of a correction lens on printing the screen 18. Accordingly, it may be assumed that the vertical component of terrestrial magnetism produce a neglible effect.

Figure 4B:
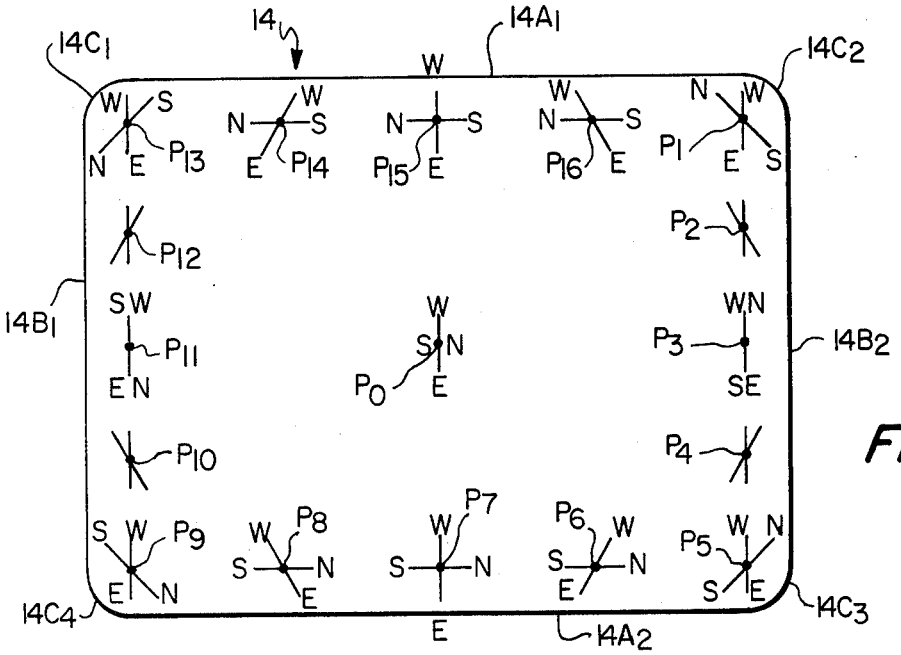
FIG. 4B is a front plan view of the face plate of a color cathode ray tube useful in explaining residual shields for the terrestrial magnetism.

The effect of the horizontal component of terrestrial magnetism upon the color shifting of a color cathode ray tube depends upon the orientation of the face plate 14 thereof as shown in FIG. 4B. When the face plate 14 successively faces the east, south, west and north, then particular beams of electrons are deflected to result in a change in the landing points on the face plate 14 as shown in FIG. 4B. FIG. 4B shows the face plate 14 defined by a pair of opposite longer sides 14A1 and 14A2, a pair of opposite shorter sides 14B1 and 14B2, and four round corners 14C1, 14C2, 14C3 and 14C4, as well as the central point Po and sixteen points $P_1$, $P_2$, . . . $P_{16}$ located in the peripheral edge thereof. Each line segment or vector shown passing through a different one of these points depicts direction and magnitude of displacement of the landing point of the respective beam of electrons, when the face plate 14 faces any of the east, south, west and north. For example, regarding the point $P_1$ at the upper right-hand corner, the landing point is displaced downwards, rightwards and downwards, upwards, and leftwards and upwards when the face plate 14 faces the east, sough, west and north, respectively, with the length between the point $P_1$ and the extremity of each segment labelled E, S, W or N indicating the magnitude of displacement in the corresponding direction. In FIG. 4A, curve C has been plotted by averaging the lengths of the line segments labelled N and S passing through all the seventeen points Po, $P_1 \ldots P_{16}$, thus indicating the residual effects on the electron beams of terrestrial magnetism, for each of the different proportions $\alpha$ of the apertures 50.

Figure 4C:
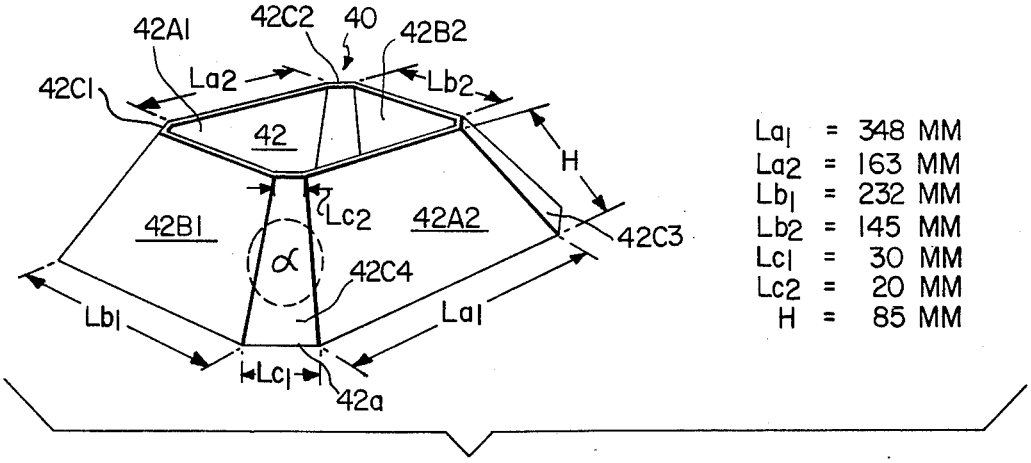
FIG. 4C is a perspective view of an internal magnetic shield used to obtain the data illustrated in FIG. 4A.

FIG. 4C shows a prototype magnetic shield 40 used to obtain the data illustrated in FIG. 4A, with the outside dimensions of the shield being shown. The magnetic shield 40 illustrated was used in a 20 inches, 110° deflection color cathode ray tube and was formed of cold rolled sheet steel 0.15 mm thick. The magnetic shield 40 included a funnel portion 42 formed of a pair of longer trapezoid-shaped side walls 42A1 and 42A2 corresponding to the pair of longer sides 14A1 and 14A2 of the face plate 14 of FIG. 4B, a pair of shorter trapezoid-shaped side walls 42B1 and 42B2 corresponding to the pair of shorter sides 14B1 and 14B2 of face plate 14, and four trapezoid-shaped corner wals 42C1, 42C2, 42C3 and 42C4 corresponding to the corners 14C1, 14C2, 14C3 and 14C4 of face plate 14. Each of the longer side walls 42A1 and 42A2 has a bottom side $La_1$ 348 mm long and a top side $La_2$ 163 mm long, while each of the shorter side walls 42B1 and 42B2 has a bottom side $Lb_1$ 232 mm long and a top side $Lb_2$ 145 mm long. Each of the corner walls 42C1 through 42C4 has a bottom side $Lc_1$ 30 mm long and a top side $Lc_2$ 20 mm long. Further, the magnetic shield 40 has an inclined height H of 85 mm, measured along the funnel portion 42. It is to be understood that all the walls of the magnetic shield 40 have apertures 50 substantially uniformly disposed therein, as in the arrangement of FIG. 4. However, in FIG. 4C the apertures 50 are omitted for purposes of clarity of illustration, and the relative proportion of the area of the apertures is designated by $\alpha$. Also, it is to be understood that FIG. 4C shows the funnel region as above defined.

From Curve A shown in FIG. 4A, it will be seen that the thermal deformation of the shadow masks 22 decreases as the proportions $\alpha$ of the apertures 50 increases, thus indicating the heat dissipation effect exhibited by the shadow masks 22. From curve A it is also seen that when the proportion $\alpha$ of the apertures 50 is in excess of 70%, there is not any additional substantial corresponding decrease in the thermal deformation of the shadow masks 22.

Further, curve C illustrates that the residual effects of terrestrial magnetism are scarcely increased as long as the aperture proportion $\alpha$ is equal to or less than 70%, but are abruptly increased when the proportion $\alpha$ exceeds 70%.

From the foregoing it has been found that satisfactory results are achieved when the proportion $\alpha$ of the apertures 50 ranges from 20 to 70%, and preferably from 30 to 60%.

It is noted that, in FIG. 4A, $\alpha = 0$ indicates the use of conventional magnetic shields without the apertures 50, and $\alpha = 100$ indicates that no magnetic shield is used.

It is known that the amount of electric power required to demagnetize the magnetic shield 40 is proportional to the volume of the magnetic material, for example steel, forming the magnetic shield. Such power requirement decreases with an increase in aperture proportion $\alpha$.

In order to increase the proportion $\alpha$ of the apertures 50, the number of the apertures 50 can be increased. Alternatively, the individual apertures may be increased in size.

Figure 5:
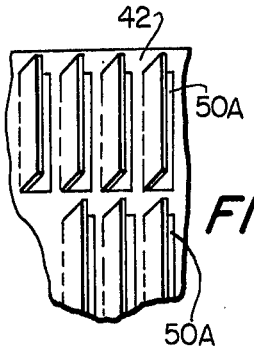
FIG. 5 is a fragmental perspective view of another internal magnetic shied constructed in accordance with the principles of the present invention.

While the present invention has been illustrated and described in conjunction with circular apertures in the magnetic shield, it is to be understood that the invention is not restricted to the circular shape and that the apertures may be square, polygon or in the form of louvers 50A as shown in FIG. 5. It is, however, essential that the magnetic shield include openings for allowing substantial heat dissipation from the shadow mask.

Also, the dimension of each aperture 50 is not essential in this invention. For example, eight larger apertures 50 of square shape may be disposed on the funnel portion 42 of the magnetic shield 40. In this case, each aperture 50 has an area of larger than 2500 $mm^2$. Such larger apertures 50 are effective in providing the advantages that the electric power for degaussing the magnetic shield 40 and the shadow mask 22 is reduced and the magnetic shield 40 can more easily be manufactured.

Figure 6:
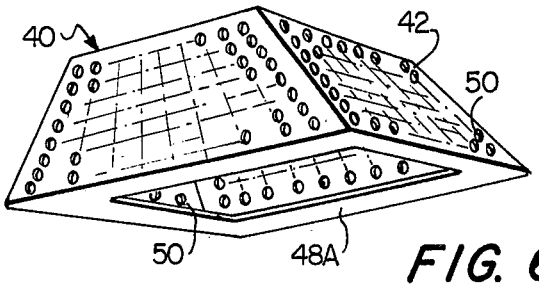
FIG. 6 is a perspective view of a modification of the present invention.

If desired, the funnel portion 42 of the magnetic shield 40 may be provided at the larger end thereof with a flat peripheral flange 48A directed inwardly toward the longitudinal axis of the envelope, as shown in FIG. 6. Then the peripheral flange 48A somewhat projects beyond the inner edge of the flange 28 of the mask frame 24 upon which the magnetic shield 40 is disposed. This arrangement insures that any beam of electrons excessively deflected outside of that portion of the phosphor screen effective for reproducing pictures will be blocked by the flange 48A, thus preventing the occurrence of color shifting or uneveness due to the irregular deflection of the electrons.

While the present invention has been illustrated and described in conjunction with the apertures 50 substantially uniformly disposed in the funnel region, it is to be understood that the apertures may be disposed in a non-uniform pattern in the funnel region.

In FIG. 4B, it will be seen that a residual displacement of an electron beam at every point on the face plate 14 facing the east will be substantially identical to that on the face plate facing the west. Also, it is seen that the residual displacements at the points $P_6$, $P_8$, $P_{14}$ and $P_{16}$ on a face plate facing the east or west appear in directions slightly tilted to the vertical, and that the residual displacements at the remaining points on a face plate facing the east or west appear in the vertical and are substantially equal in magnitude whether the face plate faces the west or the east. Further, a residual displacement at every point on a face plate facing the east is substantially equal to that on a face plate facing the west. Therefore, such residual displacements can be substantially corrected by an adjustment effected after the color television receivers have been installed. In that event, it is important to form magnetic shields for shielding the beam of electrons from terrestrial magnetism in such a mamner so as to mainly reduce residual displacements on a face plate facing either of the north and south, which residual displacements are caused from the horizontal component of terrestrial magnetism passing through the particular cathode ray tube in a direction substantially parallel to the tube axis.

It has been found that to effectively trap the horizontal component of terrestrial magnetism by a magnetic shield 40 the following is important. It will be recalled that the funnel region as above defined includes a first portion on which the larger diameter end 42*a* jointed to the shadow mask 22 is disposed and a second portion on which is disposed the smaller diameter end 42*b* spaced from the shadow mask 22. The proportion $\alpha$ of the apertures 50 is effectively small adjacent such second portion. By this measure, the horizontal component of terrestrial magnetism passing substantially parallel to the tube axis is effectively trapped on the first portion of the funnel region by the shadow mask 22 formed of a magnetic material such as steel and also effectively trapped by the second portion thereof having a small proportion $\alpha$ of apertures 50. An intermediate section between the first and secomnd portions of the funnel region need only to be provided with a magnetic path sufficient for introducing a magnetic flux trapped by one of the two funnel portions into the other funnel portion. Thus, such intermediate portion is permitted to have a proportion $\alpha$ of apertures 50 sufficiently large enough to effectively dissipate from the shadow mask.

It has been found to be desirable that the proportion $\alpha$ preferably be 20% or less adjacent the second portion of the funnel region..

Figure 7A:
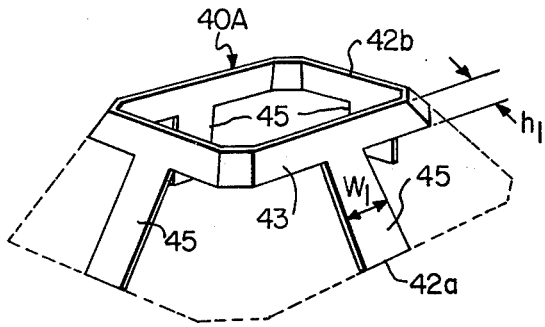
FIGS. 7A, 7B and 7C are perspective views of various further modifications of the present invention.

FIG. 7A shows a modification of the present invention constructed in accordance with the concept as above described. The shield generally designated by the reference numeral 40A includes a bridge section 43, corresponding to the second portion of the funnel region, having an inclined height $h_1$, e.g. of 20 mm, provided with no apertures. That is, the section 43 has a zero proportion of apertures. Further, each of the longer and shorter side walls of the shield includes a central strip 45 having no apertures therein, having a width $w_1$, e.g. of 30 mm, and running along the tube axis to form a magnetic path. In other respects the arrangement is identical to that shown in FIG. 4C.

Figure 7D:
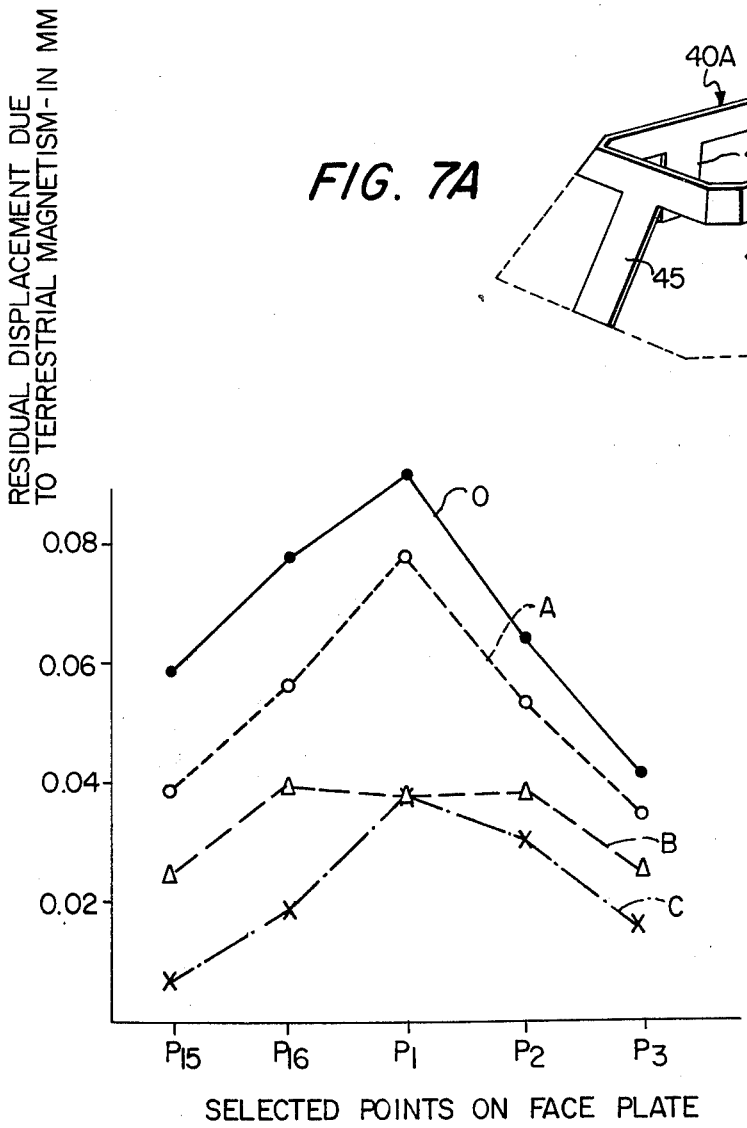
FIG. 7D is a graph illustrating residual shields for the terrestrial magnetism on predetermined points on each of the arrangements shown in FIGS. 7A through 7D.
Figure 7B:
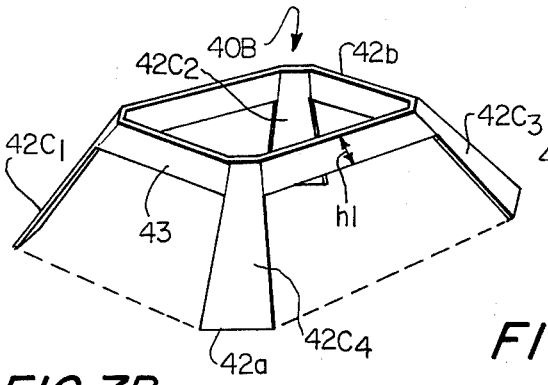

A shield arrangement generally designated by the reference numeral 40B in FIG. 7B includes a section 43, corresponding to the second funnel region portion and having an inclined height $h_1$, e.g. of 20 mm, provided with no apertures, and four corner walls 42C1 through 42C4 having no apertures therein. In other respects the arrangement is identical to that shown in FIG. 4C.

Figure 7C:
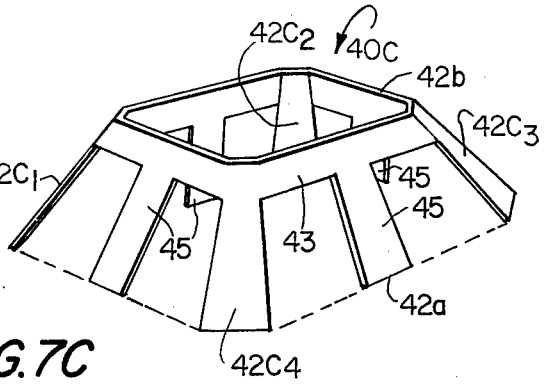

FIG. 7C shows still another magnetic shield generally designated by the reference numeral 40C and different from that shown in FIG. 4C, only in that in FIG. 7C there is provided the section 43 of the second funnel portion, e.g. 25 mm high, the central strips 45 of the side walls and the corner walls 42C1 through 42C4, all having no apertures therein.

FIG. 7D shows measured residual displacements at five points $P_1$, $P_2$, $P_3$, $P_{15}P_{16}$ (see FIG. 4B) on a face plate 14 facing the north and south and operatively coupled to the magnetic shields as shown in FIGS. 7A, 7B and 7C. The measured residual displacement at each of the five points corresponds to the length of the segment of line labelled S and N and passing through that point. Curves A, B and C illustrate displacements when using the magnetic shields 40A, 40B and 40C shown in FIGS. 7A, 7B and 7C, respectively, while curve O illustrates the use of no magnetic shield, for control and comparison purposes. The five points $P_1$, $P_2$, $P_3$, $P_{15}$ and $P_{16}$ have been selected because the residual displacements at these points are typical and representative of those on the other points on the face plate 14.

From FIG. 7D, it will be seen that the provision of the second portion of the funnel region having a small aperture proportion, for example a zero proportion, cooperates with the provision of each corner wall having a small aperture proportion, such as a zero proportion, to cause the residual displacement at the point $P_1$ in the face plate 14 corresponding to the corner wall to be small. In addition, the combination of the magnetic shield 40B as shown in FIG. 7B with the magnetic paths 45 as shown in FIG. 7A permits residual displacement to be reduced not only at the point $P_1$, but also at the points $P_2$, $P_3$, $P_{15}$ and $P_{16}$.

Figure 8:
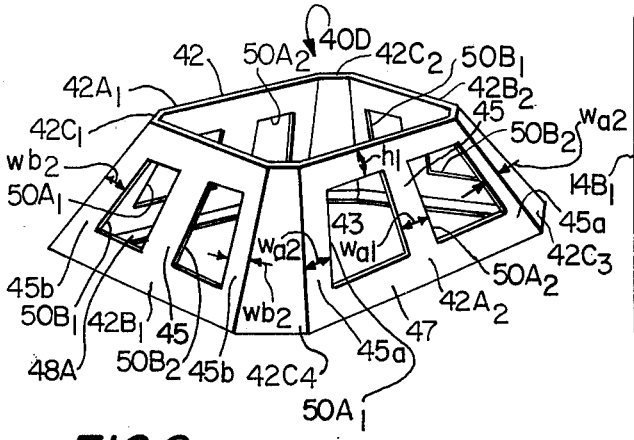
FIG. 8 is a perspective view of a still further modification of the present invention.

In FIG. 8, wherein like reference numerals designate components identical or similar to those shown in FIG. 7C, there is illustrated a modification of the arrangement shown in FIG. 7C.

The shield illustrated is generally designated by the reference numeral 40D and is used with a 20 inches, 110° deflection color cathode ray tube similar to that discussed with regard to FIG. 4C. Thus, the arrangement of FIG. 8 may be identical in outside dimensions to that shown in FIG. 4C. The shield 40D includes a pair of longer side walls 42A1 and 42A2, each provided with a pair of similarly shaped apertures 50A1 and 50A2, and a pair of shorter side walls 42B1 and 42B2, each provided with a pair of similarly shaped apertures 50B1 and 50B2. Apertures 50A1 and 50A2 are disposed in each of the longer side walls 42A1 and 42A2 so that a bridge section 43 without apertures therein and having a height $h_1$, e.g. of 20 mm, is left on the side of the smaller diameter end 42*b* of the funnel portion 42, and an additional bridge section 47 without apertures therein and having a height $h_2$, e.g. of 20 mm, is left on the side of the larger diameter end 42*a* of the funnel portion 42. This relationship is also true in the case of the apertures 50B1 and 50B2.

Further, each pair of apertures 50A1 and 50A2 have sandwiched therebetween a longitudinal central strip forming a magnetic path 45 having a width $w_{a1}$, e.g. of 20 mm, while each pair of apertures 50B1 and 50B2 have sandwiched therebetween a magnetic path 45 having a width $w_{b1}$, e.g. of 20 mm. Each of the corner walls 42C1 through 42C4 has no apertures therein and is spaced from an adjacent one of the apertures 50A1 or 50A2 by an integral apertureless magnetic path 45*a* having a width $w_{a2}$, e.g. of 7 mm, and also is spaced from an adjacent one of the apertures 50B1 and 50B2 by an integral apertureless magnetic path 45*b* having a width $w_{b2}$, e.g. of 6 mm.

In the arrangement of FIG. 8, each of the longer side walls 42A1 and 42A2 including the pair of apertures 50A1 and 50A2 has a total area of 21,740 mm², and each pair of apertures 50A1 and 50A2 has a total area of 8,360 mm², with the result that each of the longer side walls 42A1 and 42A2 has an average aperture proportion of 38.5%. Similarly, each of the shorter side walls 42B1 and 42B2 including the apertures 50B1 and 50B2 has a total area of 16,000 mm², and each pair of apertures 50B1 and 50B2 has a total area of 6,980 mm². Thus, each of the shorter side walls 42B1 and 42B2 has an average aperture proportion of 43.6%.

Regarding the entire funnel region, the inner or outer peripheral surface thereof has a total area of 83,980 $mm^2$, and the total area of the apertures 50A1, 50A2, 50B1 and 50B2 amounts to 30,680 $mm^2$. This results in an average aperture proportion of 36.6%.

It has been found that, with the funnel region having the apertures non-uniformly disposed therein as shown in FIGS. 7A, 7B, 7C and 8, an average aperture proportion ranging from 20 to 70% gives as satisfactory results as when the funnel region has the apertures uniformly disposed therein. Preferably, the aperture proportion ranges from 30 to 60%.

Figure 9A:
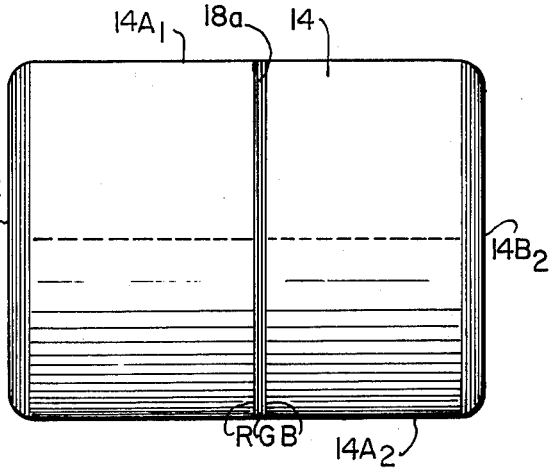
FIG. 9A is a schematic front plan view of a face plate of a color cathode ray tube having phosphors printed in stripes thereon.

While the present invention has been illustrated and described in conjunction with mosaic phosphor screens including a multitude of triads of red, green and blue phosphors printed in minute circular dots thereon, it is to be understood that the present invention is equally applicable to mosaic phosphor screens including a multitudes of red, green and blue phosphors printed in stripes running in directions substantially parallel to the shorter sides of the screens, such as shown in FIG. 9A. In FIG. 9A a face plate 14 has disposed thereon a mosaic screen **18*a* including a multitude of stripe-shaped red, green and blue phosphors R, G and B (only one set of which is illustrated) running substantially parallel to the opposite shorter side 14B1 and 14B2 of the face plate 14 which also includes a pair of opposite longer sides 14A1 and 14A2.**

Figure 9B:
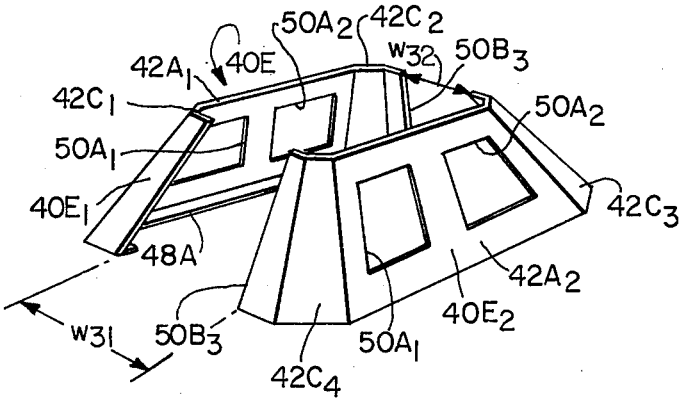
FIG. 9B is a perspective view of a different internal magnetic shield constructed in accordance with the principles of the present invention to be suitable for use with the arrangement shown in FIG. 9A.

FIG. 9B shows a magnetic shield 40E suitable for use with the screen **18*a* as shown in FIG. 9A. The arrangement illustrated is different from that shown in FIG. 8 only in that in FIG. 9B, the pair of shorter side walls 42B1 and 42B2 as shown in FIG. 8** are substantially omitted.

When the screen 14 of FIG. 9A is used, it has been found that the portion of the displacement of a beam of electrons, in a direction parallel to extensions of the stripe-shaped phosphors, due to terrestrial magnetism scarcely comes into question and therfore that the shorter side walls 42B1 and 42B2 may be omitted for practical purposes.

The shield of FIG. 9B is suitable for use in 20 inches, 110° deflection color cathode ray tubes and may be equal in outside dimension to the arrangement shown in FIG. 4C. As above described, the shorter side walls 42B1 and 42B2 which are shown in FIG. 8 are substantially omitted, and large openings 50B3 are formed to extend from the larger diameter end **42*a* to the smaller diameter end 42*b*, to physically divide the magnetic shield 40E into a pair of shield portions 40E1 and 40E2. Each opening 50B3 has a width $w_{31}$, e.g. 192 mm, on the larger diameter end 42*a* and a width $w_{32}$, e.g. of 115 mm, on the smaller diameter end 42*b*.**

Therefore, each of the shield portions 40E1 and 40E2 has a total area of 30,240 $mm^2$, and the apertures have a total area of 8,360 $mm^2$, thus resulting in an average aperture proportion of 27.6%. Considering the entire magnetic shield 40E including the openings 50B3, the inner or outer peripheral surface of the funnel region has a total area of 83,980 $mm^2$, and the total area of the apertures and openings if 41,020 $mm^2$. Therefore, there results an average aperture proportion of 49%.

The arrangement of FIG. 9B is effective for facilitating the manufacture of magnetic shields. It has been found that the overall aperture proportion of each of the shorter sides of the funnel region is preferably of 80% or more.

Other modifications may be made to the above specifically described structural arrangements without departing from the scope of the invention.

What is claimed is:

1. A color cathode ray tube for use in a color television receiver and comprising:

a. an enclosed envelope including a face plate, a funnel portion and a neck portion, said face plate being of a substantially rectangular shape including four sides and four corners;

b. a phosphor screen disposed on the internal surface of said plate and including blue, green and red phosphors;

c. electron gun means disposed within said neck portion of said envelope to generate a beam of electrons toward said screen;

d. shadow mask means, disposed in said envelope opposite to said phosphor screen, for determining the landing positions of said beam of electrons on said phosphor screen;

e. magnetic shield means, positioned within the funnel portion of said envelope, for reducing the effects of terrestrial magnetism and undesirable magnetic fields on said beam of electrons, said magnetic shield means comprising a magnetic shield body formed of sheet magnetic metal material, said magnetic shield body including four non-apertured, laterally spaced corner walls corresponding to said four corners of said faceplate, each of said corner walls being secured at a first end thereof to said shadow mask means, said magnetic shield body further comprising non-apertured bridge sections located within said funnel portion and integrally joined with and connecting second ends of at least a portion of adjacent of said corner walls;

f. said magnetic shield means being positioned within a funnel region within said envelope surrounding a path along which said beam of electrons from said electron gun means travels to said phosphor screen, said funnel region including four side portions corresponding to said four sides of said face plate and four corner portions corresponding to said four corners of said face plate, said funnel region extending from a first end thereof adjacent said shadow mask means to a second end thereof spaced from said shadow mask means, said four corner walls of said magnetic shield body being positioned within said four side portions of said funnel region, said bridge sections of said magnetic shield body being positioned within said side positions of said funnel region;

g. the peripheral area of said funnel region between said corner walls and not occupied by said magnetic shield body comprising apertures extending through said funnel region, the total area of said apertures being equal to from 20 to 70% of the total area of the peripheral surface of said funnel region.

2. A color cathode ray tube as claimed in claim 1, wherein the total area of said apertures is equal to from 30 to 60% of the total area of said peripheral surface of said funnel region.

3. A color cathode ray tube as claimed in claim 1, wherein said magnetic shield body further comprises non-apertured strip members, one each integrally joined at a first end thereof with one of said bridge sections and extending to a second end thereof adjacent said shadow mask means.

4. A color cathode ray tube as claimed in claim 3, wherein said magnetic shield body further comprises non-apertured additional bridge sections, one each integrally joined with and connecting said first ends of adjacent of said corner walls and said second end of the strip member therebetween.

5. A color cathode ray tube as claimed in claim 1, wherein said magnetic shield body further comprises non-apertured additional bridge sections, one each integrally joined with and connecting said first ends of adjacent of said corner walls.

* * * * *